United States Patent [19]

Kessel

[11] 4,275,760

[45] Jun. 30, 1981

[54] TRAP-TYPE DRAIN WITH BUILT-IN STRAINER

[76] Inventor: Bernhard Kessel, Ingolstädter Str. 20, 8073 Kösching, Fed. Rep. of Germany

[21] Appl. No.: 967,853

[22] Filed: Dec. 8, 1978

[30] Foreign Application Priority Data

Dec. 10, 1977 [DE] Fed. Rep. of Germany ..... 2755174

[51] Int. Cl.[3] ..... E03B 3/18

[52] U.S. Cl. ..... 137/546; 137/247.35; 137/247.43

[58] Field of Search ..... 137/247.27, 247.35, 137/247.39, 247.41, 247.43, 247.45, 247.47, 549, 247.11, 546

[56] References Cited

U.S. PATENT DOCUMENTS

| | | | |
|---|---|---|---|
| 664,945 | 1/1901 | Guion | 137/247.35 X |
| 1,456,105 | 5/1923 | Heinkel | 137/247.11 X |
| 1,679,190 | 7/1928 | Westbrook | 137/247.47 X |
| 2,101,978 | 12/1937 | Boosey | 137/247.35 X |
| 2,472,322 | 6/1949 | Weissman | 137/247.35 X |
| 2,564,172 | 8/1951 | Raaberg | 137/247.11 X |
| 3,651,826 | 3/1972 | Kojima | 137/247.35 |
| 4,026,317 | 5/1977 | Ekstrom | 137/247.39 X |
| 4,045,346 | 8/1977 | Swaskey | 137/247.39 X |

FOREIGN PATENT DOCUMENTS 2403979 1/1974 Fed. Rep. of Germany ..... 137/247.41

*Primary Examiner*—Harold W. Weakley
*Attorney, Agent, or Firm*—Karl F. Ross

[57] ABSTRACT

A drain trap has a housing in the form of a four-sided outer vessel with a closed bottom and with a lateral outlet extending from one of its sides, this housing receiving an insert which forms a closed-bottom inner vessel of downwardly converging frustopyramidal shape spacedly surrounded on three sides by a skirt depending from the top of the insert and defining with three apertured walls of the inner vessel a downwardly open chamber communicating with a space beneath that vessel. The fourth side of the inner vessel is solid and spacedly confronts a partition which rises from the bottom of the outer vessel and has an overflow edge across which incoming liquid from the aforementioned chamber may reach the lateral outlet.

1 Claim, 7 Drawing Figures

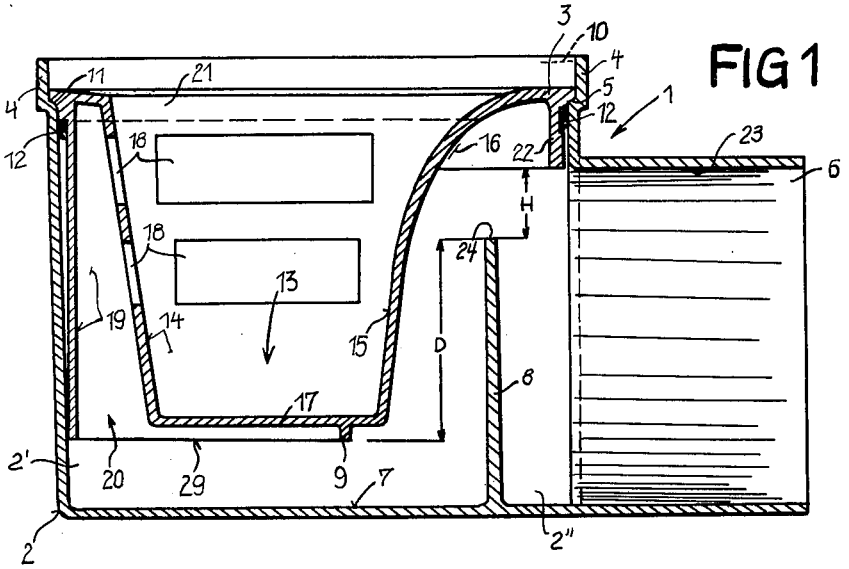
FIG 1
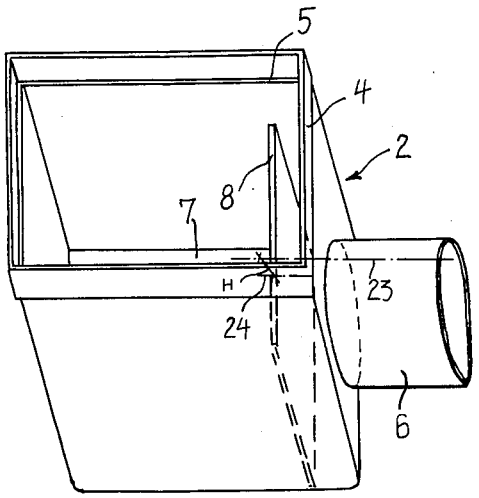
FIG 2
FIG 5b
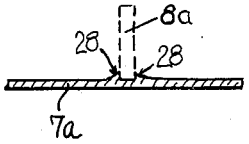
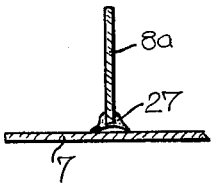
FIG 5a

FIG 3
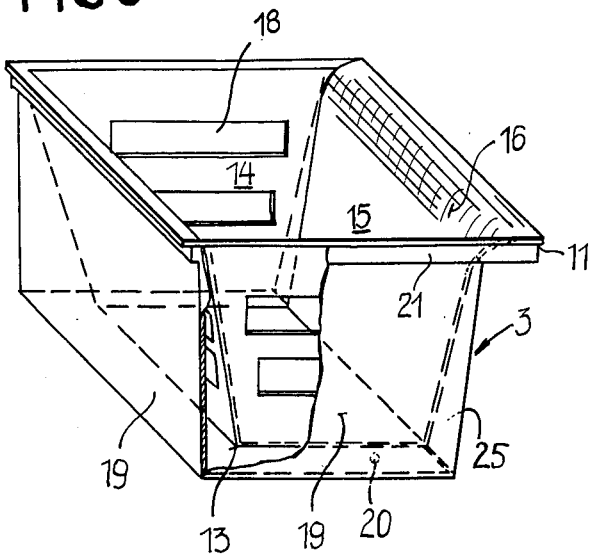
FIG 3a
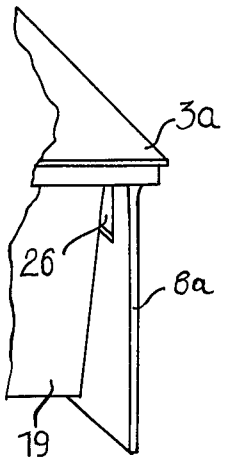
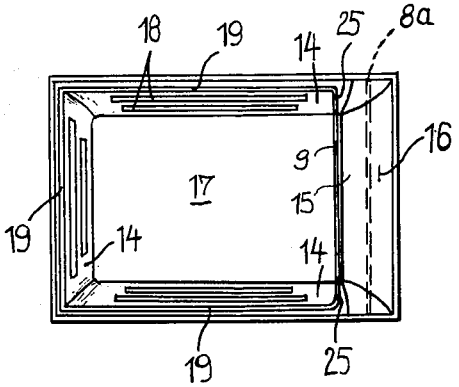
FIG 4

TRAP-TYPE DRAIN WITH BUILT-IN STRAINER

FIELD OF THE INVENTION

The present invention relates to a drain trap with a built-in strainer which may be mounted directly on a sink, tub or the like or may be recessed in a floor.

BACKGROUND OF THE INVENTION

Such a drain trap normally comprises a plurality of parts, namely a strainer for the retention of solids and at least two further parts that together form a gas and odor trap. One of these latter parts is provided with an outlet connected to a drain pipe. Reference in this connection may be made to my copending application Ser. No. 894,488 filed Apr. 7, 1978, now U.S. Pat. No. 4,198,717.

It is essential that such an arrangement have a relatively large flow cross-section at all locations along the path followed by liquid passing through it. For this reason the trap usually has a housing of considerable horizontal or vertical extent in order to accommodate the various parts of the structure without excessively restricting the flow. Thus when the strainer is arranged above the trap the device tends to be relatively tall, whereas when it is arranged next to the trap it tends to be relatively long.

Furthermore, in such arrangements the strainer is normally a separate element, so that the device must be cast in several pieces which are subsequently interconnected. As the applicable plumbing codes invariably require that a certain minimum flow cross-section be maintained throughout such traps, their design becomes relatively complex, especially when a compact structure is desired.

OBJECT OF THE INVENTION

It is therefore an object of the present invention to provide an improved drain trap which is very compact and which can be produced at relatively low cost.

SUMMARY OF THE INVENTION

I realize this object, in accordance with my present invention, by providing a drain trap with an upwardly open four-sided outer vessel having a closed bottom, one side of this vessel being formed with a lateral outlet extending from the bottom of the vessel to a high point close to the upper rim thereof. A partition paralleling the side formed with the outlet rises within the outer vessel from the bottom thereof and divides its interior into a first compartment remote from the outlet and a second compartment proximal thereto; the partition has an overflow edge at a level below the aforementioned high point. An open-topped insert suspended by a closely fitting collar from the rim of the outer vessel, in sealed relationship therewith, extends below the level of the overflow edge into the first compartment but terminates above the bottom of the outer vessel. This insert forms a downwardly converging, generally frustopyramidal closed-bottom inner vessel with a solid wall spacedly confronting the partition and with three other walls having peripheral apertures in the vicinity of the overflow level. The insert further forms a skirt depending from its collar while spacedly surrounding the three apertured walls with which it defines a laterally closed but downwardly open chamber while leaving the solid fourth wall exposed, the partition enabling liquid issuing from the wall apertures to escape into the outlet across its overflow edge while accompanying solids are retained in an imperforate lower part of the inner vessel.

BRIEF DESCRIPTION OF THE DRAWING

My invention will now be described in detail with reference to the accompanying drawing in which:

FIG. 1 is a vertical section through a drain trap according to this invention;

FIG. 2 is a perspective view from above of the housing of the trap shown in FIG. 1;

FIG. 3 is a partly broken-away perspective top-front view of an insert of the trap;

FIG. 3*a* is a perspective view of an alternative form of the insert;

FIG. 4 is a top view of an insert embodying the variation shown in FIG. 3*a;* and FIGS. 5*a* and 5*b* are fragmentary sectional detail views showing further modifications.

SPECIFIC DESCRIPTION

As shown in FIGS. 1–3, a drain trap 1 in accordance with this invention includes a basically prismatic outer vessel or housing 2 receiving a four-sided insert 3. The housing 2 has a rectangular rim 4 forming an upwardly directed shoulder 5 on which rests a rim 11 of the insert 3, with a seal 12 extending circumferentially between the two rims. An outlet conduit 6 has a lowermost portion level with the imperforate and planar floor 7 of the housing 2 and extends laterally from this housing. An upright planar dam or partition 8 subdivides the interior of the housing 2 into an inner compartment 2', in which most of the insert 3 is received, and an outer compartment 2'' communicating with the outlet conduit 6.

The insert 3 is formed with a strainer-type inner vessel 13 of downwardly converging frustoconical shape having three sidewalls 14 formed with large apertures 18 and an imperforate sidewall 15 connected via a curved web 16 with the rim 11. A planar and imperforate floor 17 extends horizontally above the floor 7 and interconnects the walls 14 and 15 with whose lower, imperforate parts it forms a well for the retention of solids accompanying the incoming liquid.

The insert 3 is formed with a downwardly extending shroud or skirt 19 having three sides spaced outwardly by a downwardly diverging gap 20 from the apertured walls 14. This skirt 19 is connected via gussets 25 (see FIG. 3) to the solid wall 15 next to which it terminates underneath the floor 17 at a rib 9. Thus the elements 9, 15, 19 and 25 together form a laterally closed and downwardly open chamber having a loweredge 29 spaced by a distance D from the upper edge 24 of the partition 8, edge 24 being spaced in turn from the high print 23 of the conduit 6 by a distance H equal to approximately one-third of the distance D. The imperforate walls of skirt 19 are flared downwardly so as to bear at their lower edges against the inside of the housing 2. The rim 11 is thickened at 21 and is formed with a heavy collar 22, extending down to the level of high point 23, so that the insert 3 will be securely held within the housing 2 and leakage upwardly between the outer edge of the insert and the inner surface of the housing is virtually impossible.

A lid 10, which may be formed as a grating with throughgoing holes, can be seated within the rim 4 on top of the insert 3. Such a lid 10 may constitute a strainer in the bottom of a sink or a floor-level plate when the unit 1 is embedded in a floor.

In use, water entering the inner vessel 13 will pass radially out through the apertures 18, leaving any heavy solid matter on the floor 17 thereof. This liquid will be able to descend through the downwardly widening gap 20 into the compartment 2' remote from outlet 6 until it is filled up to the overflow edge 24 of the partition 8. Further influx will allow the liquid to run over the partition 8 and pour out through conduit 6. A very efficient gas trap having an effective height D will be formed in housing 2 as the compartment 2' will always be filled up to the upper edge 24 whereas incoming liquid will have to pass below the lower shroud edge 29 in order to exit.

FIG. 3*a* show how, instead of a partition 8 formed unitarily with the housing 2, a partition 8*a* may be integral with an insert 3*a*. This partition 8*a* has a throughgoing hole 26 whose lower edge functionally corresponds to the overflow edge 24 of FIG. 1. The one-piece insert 3*a* also shown in FIG. 4 can therefore be lifted completely out of the housing 2 for servicing of this housing. In that event, all of the liquid in the housing 2 will be able to exit through the conduit 6. The lower edge of the partition 8*a*, as shown in FIG. 5*a*, may be provided with a seal 27 that engages the floor 7. As shown in FIG. 5*b*, a floor 7*a* may be formed with a pair of lips 28 together defining a groove in which the lower edge of the partition 8*a* is received.

I claim:

1. A drain trap comprising:

an upwardly open four-sided outer vessel with a closed bottom, one side of said outer vessel being provided with a lateral outlet extending from said bottom to a high point close to an upper rim thereof;

a partition parallel to said one side in said outer vessel rising from the bottom thereof and having an overflow edge at a level below said high point, said partition dividing the interior of said outer vessel into a first compartment remote from and a second compartment proximal to said outlet; and an open-topped insert suspended by a closely fitting collar from said rim in sealed relationship with said outer vessel while terminating above the bottom thereof, said insert extending below said level into said first compartment and forming a downwardly converging, generally frustopyramidal closed-bottom inner vessel with a solid wall spacedly confronting said partition and with three other walls having peripheral apertures in the vicinity of said level, said insert further forming a skirt depending from said collar while spacedly surrounding said three other walls and defining therewith a laterally closed but downwardly open chamber while leaving said solid wall exposed, said partition enabling liquid issuing from said apertures to escape into said outlet across said overflow edge while accompanying solids are retained in an imperforate lower part of said inner vessel.

* * * * *